United States Patent [19]

Lindenberg

[11] 3,940,565

[45] Feb. 24, 1976

[54] TIME DOMAIN SPEECH RECOGNITION SYSTEM

[76] Inventor: Klaus Wilhelm Lindenberg, 929 Osceola Ave., Winter Park, Fla. 32789

[22] Filed: July 27, 1973

[21] Appl. No.: 383,293

[52] U.S. Cl. ..... 179/1 SA
[51] Int. Cl.[2] ..... G10L 1/00
[58] Field of Search ..... 179/1 SA, 1 C, 1 D, 1 E

[56] References Cited

UNITED STATES PATENTS

| | | | |
|---|---|---|---|
| 3,278,685 | 10/1966 | Harper | 179/1 |
| 3,546,584 | 12/1970 | Scarr | 179/1 SA |

OTHER PUBLICATIONS

Lindenberg, K., and Gusteland, R., "Automatic Speech Sound Recognition using Time Domain Properties", Proc. of IEEE Region III Convention, Apr. 26–28, 1971.

Lindenberg, K., "A Time Domain Speech Recognition System," Dissertation Ph.D., Northwestern U., June 1972.

Nassambene, E. G., "Speech Analyzing Circuitry," IBM Tech. Bulletin, Vol. 6, No. 7, Dec. 1963.

K.W. Lindenberg, "A Time Domain Speech Recognition System," Ph.D. Dissertation, Northwestern U., June 1972.

*Primary Examiner*—Kathleen H. Claffy
*Assistant Examiner*—E. S. Kemeny
*Attorney, Agent, or Firm*—Cushman, Darby & Cushman

[57] ABSTRACT

A time domain speech recognition system is disclosed wherein a speech signal is infinitely clipped in order to derive its zero crossover pattern. A pitch pulse detector generates standardized marker pulses in synchronism with the glottal pressure pulses occurring during voiced sounds. Using these marker pulses as trigger signals, a sampling gate samples the infinitely clipped speech signal in synchronism with the glottal pulses. In the absence of a voiced signal, sampling is performed at a pseudo random rate. The zero crossing samples obtained are normalized with respect to voice pitch and are classified as belonging to a particular set of speech sounds called phonemes in accordance with a number of parameters including number and length of the zero crossover intervals, the length of the pitch pulse interval and the relative number of changes in the duration of the crossover intervals in a pitch pulse interval.

7 Claims, 10 Drawing Figures

I-1
I-2
I-3
I-4
I-5
I-6
I-7
I-8
I-9
I-10
I-11
I-12
I-13
I-14
210
211
212
213
214
215
216
217
218
219
220
221
222
223
225
226
227
228
230
231
232
234
235
236
280
281
A
B
C
1ωl
101

TIME DOMAIN SPEECH RECOGNITION SYSTEM

BACKGROUND OF THE INVENTION

This invention relates to a time domain speech recognition system which utilizes the zero crossing pattern of infinitely clipped voice signals to determine and classify speech sounds.

In the past automatic recognition of speech signals has been beset by a fundamental problem, namely, the difficulty of abstracting from a complex input speech signal those parameters which are necessary for the recognition of the speech signal. The inability to overcome this difficulty has led to recognition systems which are unnecessarily complex, inefficient and error prone. Thus despite the intense interest in the automatic recognition of speech signals and the great body of literature written on this subject, none of the systems developed to date have been successful enough to be commercially practicable.

Speech recognition systems suffer from two major difficulties; the first of these is the wide difference in individual speech characteristics and the second is that an increase in system vocabulary typically requires a correspondingly substantial increase in system hardware for deciphering the speech signal. With respect to the problem of the variance of characteristics of individual speakers, a number of experimental systems have been developed which perform well when the sounds of a single individual speaker are detected. Thus in one prior art system, word recognition is based on digital autocorrelation analysis followed by computer pattern matching. The speech signal is split into two frequency bands and the signals in each band are then quantized into two amplitude levels, autocorrelated, and delivered to a computer for identification with respect to a predetermined pattern. Despite a severe vocabulary restriction, i.e., ten words, recognition accuracies for individual speakers varied from 78% to 90%. When three speakers were tested in the system, the accuracy dropped to 57%.

In a second prior art system, a low Q dispersive delay line was used as a model of the human cochlea which system produced slightly better results. In this system vowel sounds were investigated and the system's accuracy approached a reasonable 90% limit only when male speakers were tested. None of the prior art systems, however, have been capable of detecting and recognizing the speech of a wide variety of people including both men and women.

With respect to the second major difficulty with speech recognition systems, namely, that system hardware increases substantially with vocabulary, systems have been designed to recognize syllables or words rather than individual speech sounds in order to reduce system complexity. Thus, for example, in a speech recognition system which was designed to recognize digits, it was not necessary to differentiate precisely between the vowel sound o as in "oh" and the vowel sound ee as in "eeh" since "eeh" is not one of the words for which the system is designed to detect. As long as "ee" does not correlate closely with one of the vocabulary words "one" through "nine," the machine can either define it as "oh" or reject it altogether as undefinable. Whichever alternative the machine elects, the necessity for precise differentiation between o and ee is circumvented. Such a system also obviates the problem that individual speech sounds appear to have different characteristics depending upon their phonetic context. These systems are still limited to a small vocabulary because reasonable accuracy has been difficult to attain and because of the extensive hardware required for recognizing more than a limited vocabularly.

The advent of high speed digital computers has alleviated a third major problem inherent in many of the prior art speech recognition systems, namely, the problem of real time operation of the recognition system. Historically the predominate approach to speech recognition has been via the frequency domain, either by investigating the frequency spectrum of the speech signal directly or by tracking only the peaks of the spectral energy distribution of the signal with respect to time. In either case, the recognition system must usually perform either short-time Fourier transformations on the signal or perform auto and crosscorrelation calculations in the pattern comparison and matching phases. These calculations are difficult to perform in real time because high speed computers are necessary to perform the extensive calculations as rapidly as the speech sounds are generated.

Relatively few investigations have dealt with the temporal structure of the speech signal. From the earliest investigations through the development of the speech spectrograph and Vocoder to the most recent systems, the emphasis has been almost exclusively on spectral analysis of the speech signal. The research dealing with such temporal speech signal properties as the rate of zero crossings thereof often treats such properties merely as a reflection of the frequency domain properties of the signal. It has now been discovered, however, that the analysis of the distribution or pattern of zero crossings of a signal, the relationships among the adjacent intervals between zero crossings, and voice pitch together with pitch synchronous sampling of the speech signal can lead to an accurate means of identifying individual speech sounds. It has further been found that such a method is largely insensitive to individual speaker differences and phonic context.

In view of the foregoing it is an object of this invention to provide an accurate time domain speech recognition system which is capable of recognizing the speech sounds generated by individuals having a wide variety of speech characteristics.

SHORT STATEMENT OF THE INVENTION

Accordingly, this invention relates to a time domain speech recognition system including means for infinitely clipping the speech signal in order to derive its zero crossing pattern. Means are provided for deriving the glottal pulse repetition rate when glottal excitation is present and for generating a marker pulse in synchronism with each glottal pulse. The infinitely clipped signal is synchronously sampled with every Nth glottal pulse wherein N ranges as high as 5. In the absence of glottal pulses, sampling takes place at a pseudo random rate which approximates the last measured glottal repetition rate. The parameters of the zero crossing pattern are then determined, such as, for example, the glottal pitch pulse period, the total number of zero crossover intervals in a pitch pulse period, the length of each of the intervals and the relative number of changes of length of the intervals within the pitch pulse period. These various pattern characteristics or parameters are then utilized by means of logic circuitry to determine the speech sound, i.e., phoneme, to which a particular speech input signal corresponds.

BRIEF DESCRIPTION OF THE DRAWINGS

Other objects, features, and advantages of this invention will become more fully apparent from the following detailed description, appended claims and the accompanying drawings in which:

DETAILED DESCRIPTION OF THE PREFERRED EMBODIMENT

Figure 1:
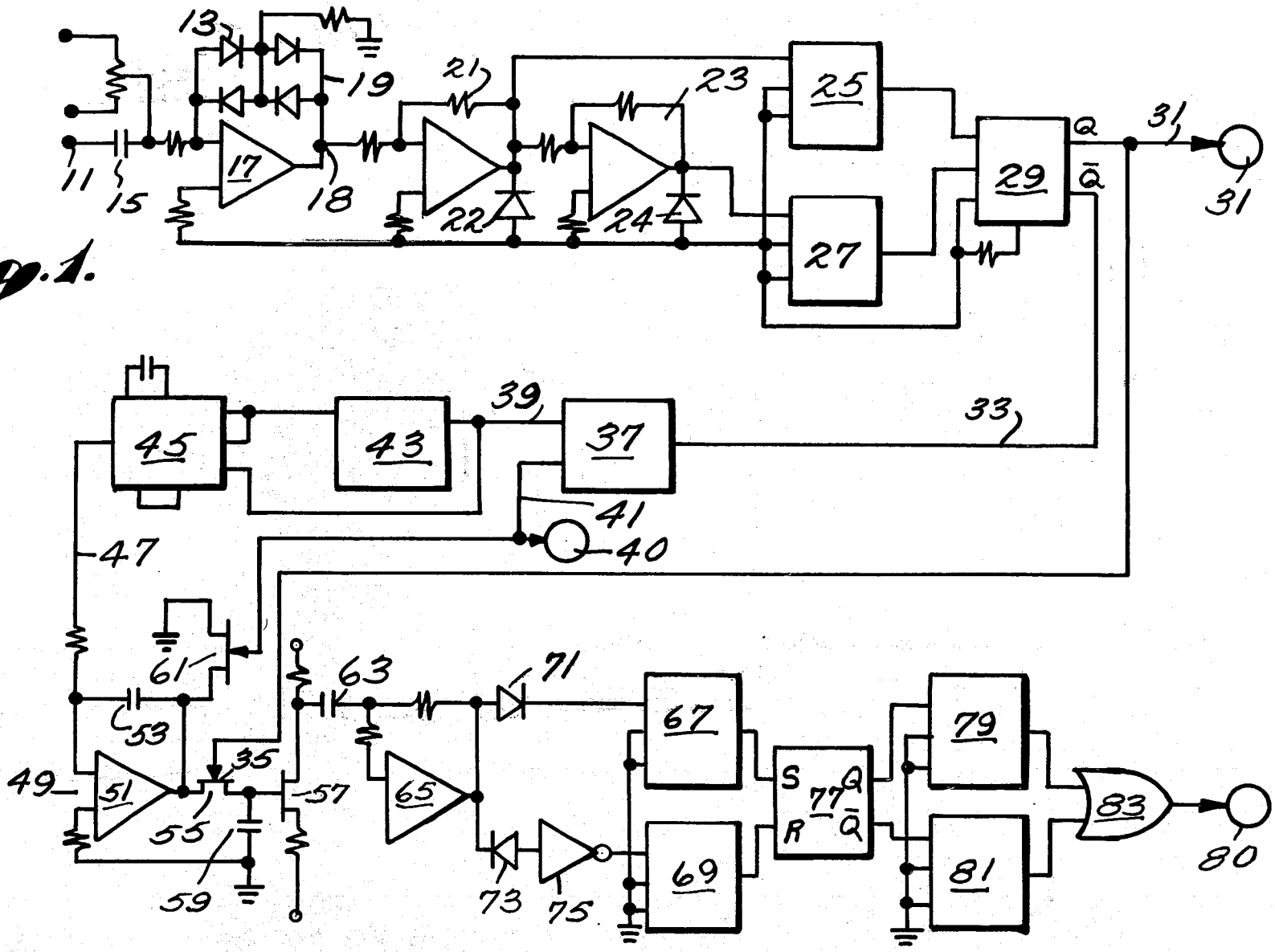
FIG. 1 is a schematic circuit diagram of the zero crossing and zero crossover time interval reversal detector of this invention.

In the act of speaking the human articulatory apparatus produces a complex acoustic wave. To transmit this wave with good fidelity, a transmitting channel capacity in excess of fifty thousand bits per second is required. However, a large number of psychophysical experiments indicate that the human auditory system which is the primary receiver of speech has a channel capacity of only 50 bits per second. This disparity between apparent signal complexity and receiver capability means that those parameters which are necessary for recognizing sounds must be relatively few in number and must vary rather slowly in time. In addition, it is apparent that the speech signal is highly redundant. Accordingly, a large part of the acoustical wave is unnecessary and may well act as noise as far as the human auditory system is concerned. For example, it has been found that amplitude variations of a speech signal do not carry much useful information in the recognition process. A large body of experimental evidence has been gathered which shows that intelligibility of a speech signal is quite insensitive to amplitude distortion and in fact, in certain high noise environments, infinitely clipped speech in which all amplitude information is disregarded is often more intelligible than normal speech.

It also has been found that the signal frequency per se of speech does not carry much speech information. Thus, a change in the frequency content of a voice signal may or may not result in a change of the word or syllable perceived depending upon the context of the changed portion of the signal. Further, speech conveyed by means of radio or telephone although often severly distorted or bandwidth limited does not present any difficulty to the human listener in deciphering the speech being transmitted. Accordingly, applicant has investigated the zero crossover pattern within one pitch pulse interval in order to determine whether it contains decipherable information relating to the recognition of speech sounds.

Voice pitch is defined as a fundamental frequency of vibration of the vocal cords. Thus speech sounds which are accompanied by vocal cord vibrations are said to be voiced while sounds which do not involve vocal cords are unvoiced. The frequency range of the voice pitch ranges from zero Hz up to 300 Hz. Voice pitches above 300 Hz rapidly become unintelligible.

Applicant has discovered that the zero crossing pattern of an infinitely clipped voiced signal contains enough information to recognize the speech signal and that at least part of the information in the zero crossing pattern is encoded in the pattern rather than in the number of crossings. In addition, it has been discovered that the parameters in the zero crossing pattern for recognizing speech sounds vary relatively slowly and that the zero crossing pattern is highly redundant, e.g., a 20% sample thereof was taken and fairly good intelligibility was found to remain in the signal. Accordingly, it has been found that by sampling the voice signal in pitch synchronism with glottal pulses most of the intelligence conveyed by the signal can be recovered.

This discovery is particularly important because the relationship between glottal frequency and a corresponding change in the formant frequency of the infinitely clipped input speech signal is approximately linear. An increase in glottal frequency means that glottal pulses will occur more ofen per unit of time, i.e., they will be more closely spaced. Since formant frequencies rise proportionately, the overall effect is to compress the zero crossing pattern in time. Accordingly, the structure of a zero crossing sample when taken pitch synchronously will remain unchanged. Thus the differences between the speech of men and women which are primarily due to differences in glottal frequencies as well as the resonant frequencies of their vocal cavities can be substantially cancelled out of the input speech signal by taking pitch synchronous samples of the zero crossing pattern of the speech signal. The corresponding sounds for both men and women will therefore provide similar zero crossing patterns. Thus the traditional problem of recognizing both the speech of men and women can be overcome by pitch synchronous sampling and infinitely clipping a voiced signal.

It has been found experimentally that each of the 6 vowel sounds /ae/,/a/,/ə/,/i/,/u/, and /o/ provide a distinct zero crossover pattern having a characteristic depending upon the following parameters:

1. Pitch period, which is the length of the speaker's glottal pulse interval in milliseconds, 2. the time duration of the intervals between zero crossovers, 3. the number of time or zero crossover intervals in a pitch pulse period, and 4. the number of times that the respective intervals of the zero crossover pattern change from a pattern of increasing intervals between zero crossovers to decreasing intervals, and vice versa, which changes are designated the jaggedness of the voice pattern. The formula for the jaggedness of the pattern is given as follows:

$$\Delta S = (\text{number of time interval reversals} + 1)/(\text{number of intervals} - 1)$$

where a time interval reversal occurs when the next succeeding zero crossover interval decreases in length after a succession of time intervals of increasing duration or, vice versa. In defining the jaggedness of the voice pattern, successive time intervals of the same duration are not considered to be time interval reversals. With these aforementioned parameters, the speech signal can be recognized by infinitely clipping the speech signal, deriving the values of the aforementioned parameters and appropriately classifying the aforementioned speech parameters in the manner which will now be explained.

The classification must be performed in the exact sequence to be given, i.e. /i/,/ae/,/u/,/o/,/ə/,/a/. The classification criteria at any step rest upon the assumption that the pattern has failed to satisfy all prior criteria. The criteria for determining that the input speech signal contains the sound or phoneme /i/ is as follows:

1. The pattern must contain at least one crossover interval of length equal to one tenth of a millisecond, hereinafter designated length 1, and the sum of the total number of intervals one tenth of a millisecond long plus the total number of intervals two tenths of a millisecond long, hereinafter designated length 2, must be at least half of the total number of intervals of the pattern.

In order for the zero crossing pattern to be classified as /ae/, it must satisfy at least one of the following criteria:

a. The zero crossover pattern must contain at least one interval of length 1, or

2. The pattern must have a pitch period greater than 9 milliseconds (p.p. 9) and contain at least one zero crossover interval of length 2.

It can be seen that the crossover interval for /i/ has high frequency components therein because the length of the zero crossover intervals are relatively short. This classification holds true regardless of the pitch period of the pattern. The classification of /ae/ is affected somewhat by the voice pitch and oral resonances. Although this sound still has predominant high frequency components, these components are not as strong as those of the /i/ sound and for very long pitch periods, the downward shift of these components becomes important. This is reflected in the second criteria wherein when the pitch pulse interval is greater than 9 milliseconds, there must be at least one zero crossover interval of length 2.

The classification of the sound /u/, must satisfy one of the following three criteria:

1. Contain exactly four zero crossover intervals, or

2. the pitch period must be greater than 5.7 milliseconds but less than or equal to 7.5 milliseconds, contain less than nine zero crossover intervals and contain three or more intervals having a length greater than 10, or

3. the pitch period must be greater than 7.5 milliseconds, contain less than nine zero crossover intervals and contain three or more intervals of length greater than 12.

Criterian 1 is a result of the fact that /u/'s have a very short zero crossover pattern. If, however, low pitched voices are detected, the shifting or resonant frequencies downward is taken into account as is the extra intervals present in the longer pitch periods. In this case the /u/'s are identified by the second or third criteria.

In order for a pattern to be classified as the sound /o/, the pattern must satisfy one of the following six sets of criteria:

1. The pitch period must be less than or equal to 5.7 milliseconds and contain exactly six zero crossover intervals; or

1. the pitch period must be less than 4 milliseconds, contain exactly eight zero crossover intervals and contain at least one interval of length greater than 9; or

3. the pitch period must be between 4 milliseconds and 5.7 milliseconds, contain exactly eight zero crossover intervals and contain at least one interval of length greater than 13 or at least two intervals of length greater than 8; or

4. the pitch pulse period must be greater than 5.7 milliseconds and the zero crossover pattern must contain less than nine intervals; or

5. the pitch pulse period must be between 5.7 milliseconds and 7.5 milliseconds, contain exactly ten zero crossover intervals and contain at least two intervals of length greater than 1 millisecond; or

6. the pitch pulse period must be greater than 7.5 milliseconds, contain exactly ten zero crossover intervals and contain at least one interval of length greater than 1.2 milliseconds.

From the classification of /O/ it can be seen that it is necessary to split the pattern into four distinct groups on the basis of pitch period. For the high pitch voices i.e., voices having a pitch period of less than or equal to 5.7 milliseconds, the identification of /O/ is based on the length of the pattern, that is, the number of intervals being 6 or 8 together with the appearance of rather long zero crossover intervals within the pattern. For the lower pitch ranges, the /o/ patterns resemble the /u/ pattern except that they lack the extremely long intervals associated with /u/.

The criteria for classifying /e/ includes one of the following two rules:

1. The jaggedness, or ΔS, value, of the pattern as defined by the aforementioned equation (1) must be less than 0.6; or

2. the pitch pulse period must be greater than 5.7 milliseconds and the zero crossover pattern must contain exactly ten intervals.

All remaining patterns are classified as /a/. The /ə/ and /a/ patterns typically have a large number of zero crossover intervals for a given pitch pulse interval. Thus for pitch periods shorter than 5.7 milliseconds any pattern having 8 or more zero crossover intervals is places in one of these two categories, which for pitch periods greater than 5.7 milliseconds any pattern having more than ten intervals is assigned to the /ə/ or /a/ sounds. The sound /a/ is separated from / / by the ΔS criteria.

The aforementioned rules were derived from examining the zero crossover patterns of a number of subjects. It should be understood that with further testing of a greater plurality of subjects, the aforementioned rules will vary somewhat. However the principle remains the same, namely, that speech can be recognized if it is infinitely clipped and the following parameters are isolated and determined: pitch pulse period, the number and length of zero crossover intervals in a pitch pulse period and the value of ΔS which is designated the jaggedness of the pattern.

Figure 3:
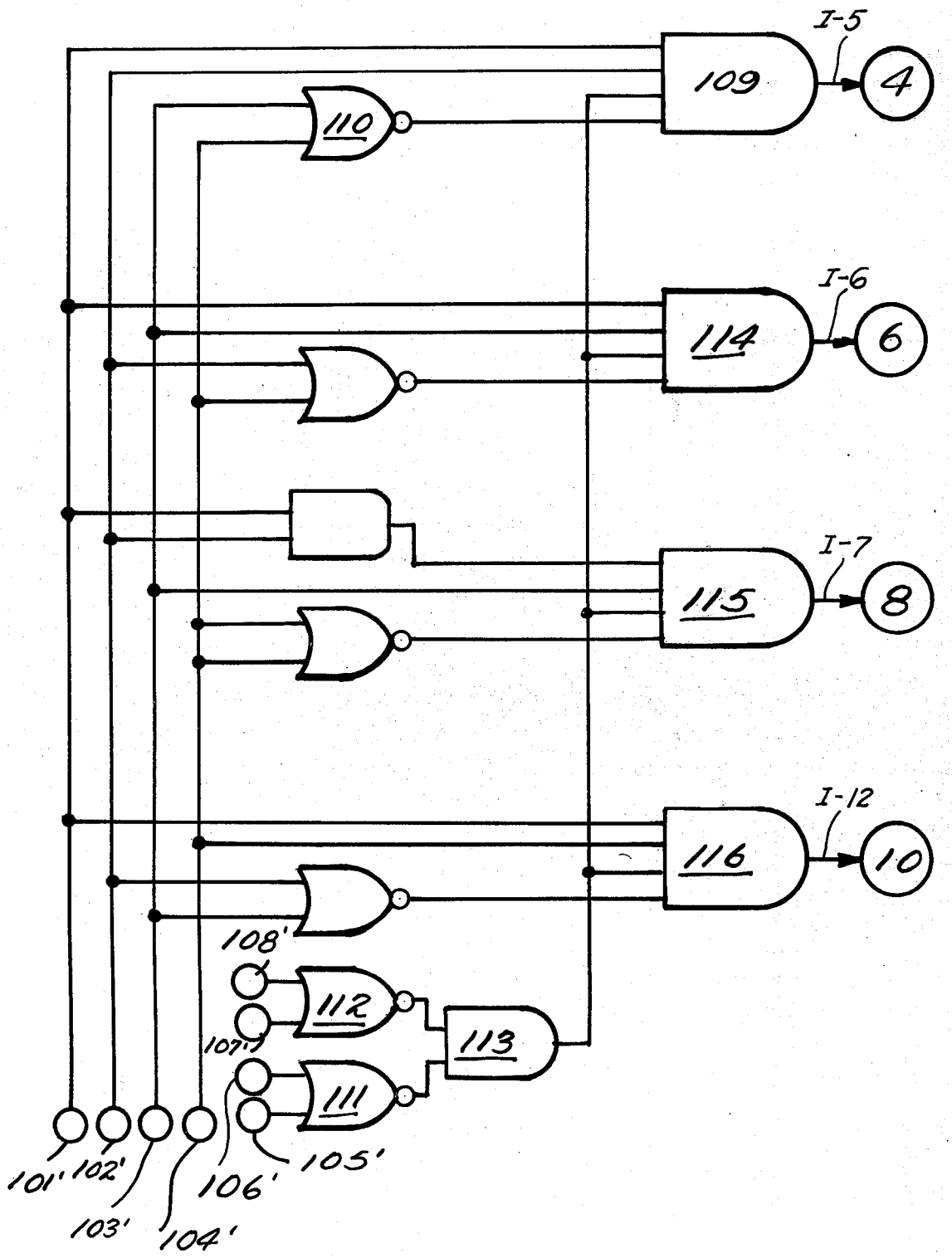
FIG. 3 is a logic circuit for determining if the number of zero crossover intervals is equal to 4, 6, 8 or 10.
Figure 9:
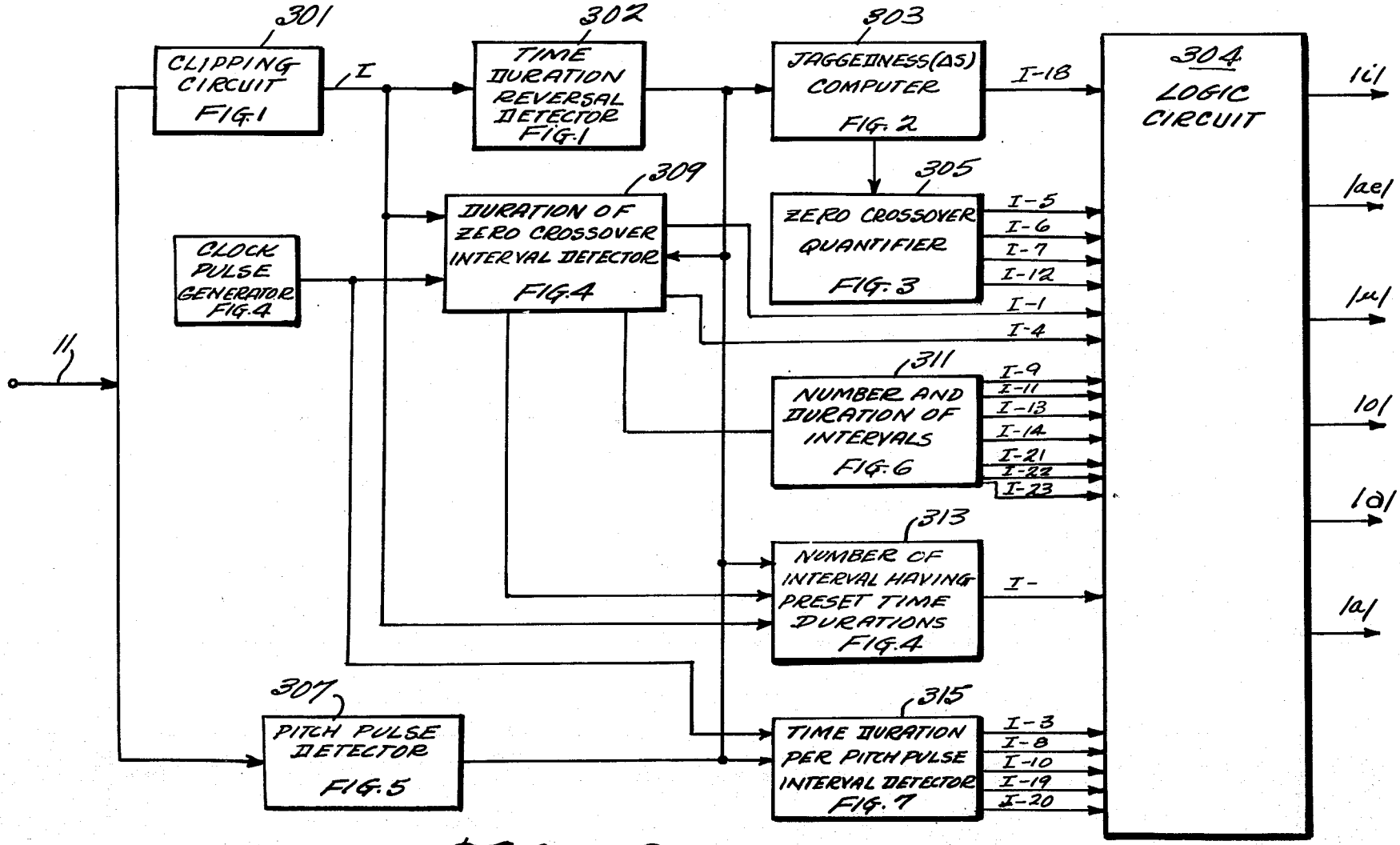
FIG. 9 is a schematic block diagram of the time domain speech recognition system of the present invention.

Refer now to FIG. 9 which is a schematic block diagram of the domain speech recognition system of the present invention. Speech from a subject is received by a microphone and converted into an electronic signal which is coupled to the input terminal 11 of the system. The signal is coupled to a clipping circuit 301 which obtains the zero crossover pattern of the input signal. The output of the clipping circuit 301 is coupled to a time duration reversal pattern circuit 302 which provides an output when a shorter crossover interval follows a longer one or vice versa, but not when a series of successive zero crossings intervals are progressively longer, shorter or remain the same. The output of the time duration reversal pattern circuit 302 is coupled to a jaggedness, ΔS, determining circuit 303 which determines whether the jaggedness, ΔS, is greater than or equal to 0.6. The output of this circuit is coupled to terminal I-18 of the logic circuit 304. As will be explained hereinbelow, the logic circuit 304 determines the presence of the phonemes /ae/, /a/, /e/, /i/, /u/, and /o/. In addition, a zero crossover qualifier, more fully disclosed in connection with the discussion of FIG. 3, provides outputs indicating that the number of zero crossings in a pitch pulse is equal to 4, 6, 8 or 10. These outputs appear on output lines I-5, I-6, I-7 and I-12.

As will be more fully discussed in connection with FIG. 4, the duration of the zero crossover interval must be determined and this is accomplished by circuit 309. At the input of circuit 309 is a signal corresponding to the occurence of a zero crossing of the clipped input signal and in addition the output of 10 kHz clock pulse generator is coupled thereto. The output of the duration of zero crossover interval circuit 309 is coupled to circuit 311 which computes the duration and number of intervals in each zero crossover pattern. The output of the number and duration of intervals computing circuit 311 is also coupled to the logic circuit 304. In addition, the output of the duration of zero crossover interval circuit 309 is coupled to a circuit 313 which determines the number of intervals having a preset time duration. This circuit is more fully disclosed in FIG. 4 and functionally sums the number of intervals having a duration of between 0.1 and 0.2 milliseconds and compares this summation signal with one-half of the total number of intervals in the pitch pulse perios. The output of this circuit is also coupled to the logic circuit 304.

Figure 7:
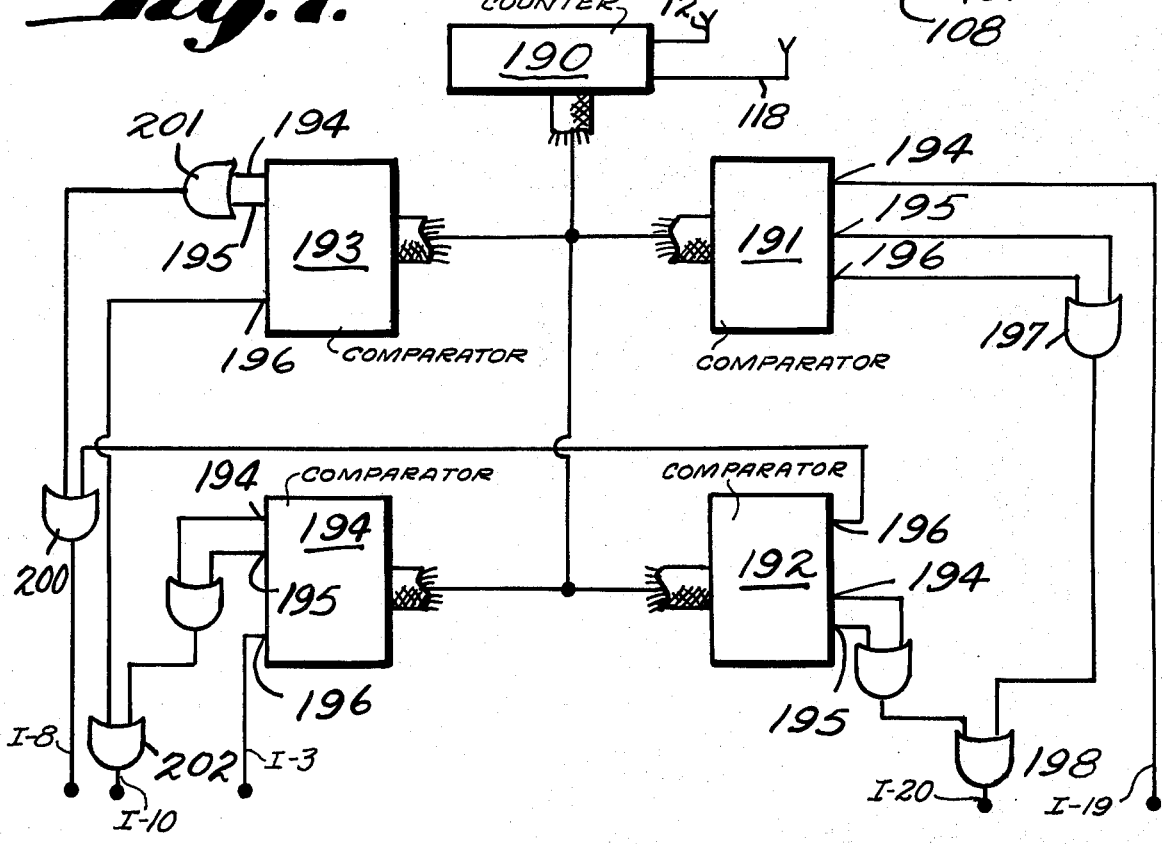
FIG. 7 is a circuit for determining and classifying the pitch periods.

Finally, the time duration interval ciruit 315 illustrated in greater detail in FIG. 7 is provided which computes five different time duration intervals into which each pitch pulse periods falls. The output of this circuit is also coupled to the logic circuit 304 for determining what phonemes are present in the input speech signal.

Now refer to FIG. 1, for a detailed description of the preferred embodiment for carrying out applicant's time domain speech recognition system. Speech from a subject is received by a microphone and converted into an electronic signal which is coupled to the input terminal 11 of the speech recognition system of the present invention. This signal is coupled to a zero crossover detector, generally designated by the numeral 13, through a differentiating capacitor 15. The zero crossover detector 13 includes an operational amplifier 17 of conventional design and a diode array 19 in the feedback path thereof. Thus for input signals having a relative low amplitude, the diodes provide a high resistance in the feedback path thereby increasing the amplification or gain of the operational amplifier 17. Conversely, when the input signals are of a higher magnitude, the diodes present a low feedback resistance thereby substantially decreasing the amplification of amplifier 17. Accordingly, it can be seen that the zero crossover detector is essentially a device for limiting the input thereto wherein the detector has very little hysteresis. The signal provided at the output 18 of the zero crossover detector can be considered to be infinitely clipped since substantially all the amplitude information has been removed therefrom. This signal is coupled to the inputs of amplifiers 21 and 23. Amplifiers 21 and 23 serve two functions, namely, to clamp and amplify the square wave so that the output of amplifier 21 can be utilized to drive one-shot multivibrator 25 and the output of amplifier 23 can be utilized to drive one-shot 27. The output of amplifier 21 is a square wave signal having a positive going voltage during the time when the output of the zero crossover detector 13 is negative. The output of amplifier 23 is the complement of the output of amplifier 21, with its output going positive when the output of detector 13 is positive. The signals from amplifiers 21 and 23 are clamped to a reference potential, such as, ground by means of diodes 22 and 24, respectively.

The outputs of one-shot multivibrators 25 and 27 which are of conventional design are coupled to the input of a third one-shot circuit 29, which produces an output pulse for each input pulse coupled thereto from one-shots 25 and 27. Thus one-shot 29 produces an output pulse for each zero crossing of the infinitely clipped input speech signal. The Q output of one-shot 29 appears on line 31 and is coupled directly to an FET 35. The complement of the output, Q, appears on line 33 and is coupled to a one-shot multivibrator 37 which generates an output on line 39 which has the same waveform as the Q output of circuit 29 but which is time delayed by the inherent time delay of one-shot 37. One shot 37 also provides on line 41 the complement of the output on line 39 which signal is coupled to FET 61 and terminal 40.

One-shot 43 provides an output pulse each time the input thereto goes in a positive direction. This pulse enables bistable circuit 45 to generate an output pulse on line 47 having a duration which depends on when the next negative going transition at the output of one-shot 37 on line 39 occurs. This negative going transition occurs when the next succeeding zero crossover occurs, and accordingly the output of bistable circuit 45 provides an output signal having a duration equal in time to the time period between zero crossings of the infinitely clipped input speech signal.

The output signal on line 47 is integrated by integrating circuit 49 which includes an operational amplifier 51 of conventional design and a feedback capacitor 53 which must be of suitable value to provide linear integration over a time period of greater than 2 milliseconds. The output of the integrating circuit 49 is coupled to a sample and hold circuit which includes FETs 55 and 57 and and holding capacitor 59.

In operation when the output of one-shot circuit 29 goes positive to indicate a zero crossover condition, FET 55 is turned on to thereby permit the voltage output of the integrator 49 to be stored in holding capacitor 59. At the end of the pulse generated by one-shot 29, one-shot circuit 37 provides an output pulse which turns on FET 61 which then rapidly discharges capacitor 53, to thereby reset the integrator 49 for charging during a second cycle. It thus can be seen that the integrator circuit provides a ramp signal having an instantaneous value which is proportional to the elapsed time from the occurrence of a first zero crossing of the infinitely clipped input speech signal and has a maximum value which occurs at the next succeeding zero crossing thereof. At the next zero crossing, FET 35 is turned on by the Q output of one-shot 29 and the value of the ramp function is stored in the sample and hold circuit. The integrator is then reset for a second charging cycle.

If the zero crossover pattern consists of successively longer time intervals, the output of FET 57 will be an upwardly going staircase wave, while successively shorter time intervals between crossovers will produce a downwardly going staircase. Alternately shorter and longer intervals will produce upward and downward going steps respectively. Capacitor 63 differentiates these steps thereby producing positive spikes for positive going steps and negative spikes for negative going steps. These spikes or pulses are amplified and inverted by amplifier 65. The positive going spikes or pulses are coupled to one shot 67 via diode 71, and negative going spikes are coupled to one shot 69 via diode 73 and invertor 75. One shot circuits 67 and 69 provide output pulses which trigger flip-flop circuit 77. Accordingly, a positive transition at the output of FET 57 causes flip-flop 77 to be cleared. Further positive transitions have no effect thereon, since the flip-flop only changes state when a negative going pulse or spike appears at the input of amplifier 65. Accordingly, the flip-flop remains in the same state until the time interval between zero crossings of successive time intervals of the infinitely input signal reverses. Once the state of the flip-flop 77 is changed, i.e., flip-flop 77 is reset, a subsequent setting thereof will not occur until a positive going spike is coupled to one shot 67.

It can be seen that the flip flop 77 changes state only when the time intervals between successive zero crossings of the infinitely clipped input speech signal changes from a state of progressively increasing to one of progressively decreasing or vice versa. Stated in another manner, the flip flop 77 provides an output when a shorter crossover interval follows a longer one or vice versa, but not when a series of successive zero crossing intervals are progressively longer, shorter or remain the same. Thus, this circuit generates pulses which indicate the number of time inteval duration reversals required to calculate the ΔS criteria of formula (1) for determining the jaggedness of the infinitely clipped speech pattern. The Q and Q outputs of flip flop 77 are coupled to one shot circuits 79 and 81, respectively, the outputs of which are coupled to OR gate 83. The number of pulses per pitch pulse period appearing at the output of OR gate 83 is equal to the number of time interval duration reversals of the infinitely clipped input signal. These output pulses are coupled to output terminal 80.

Figure 2:
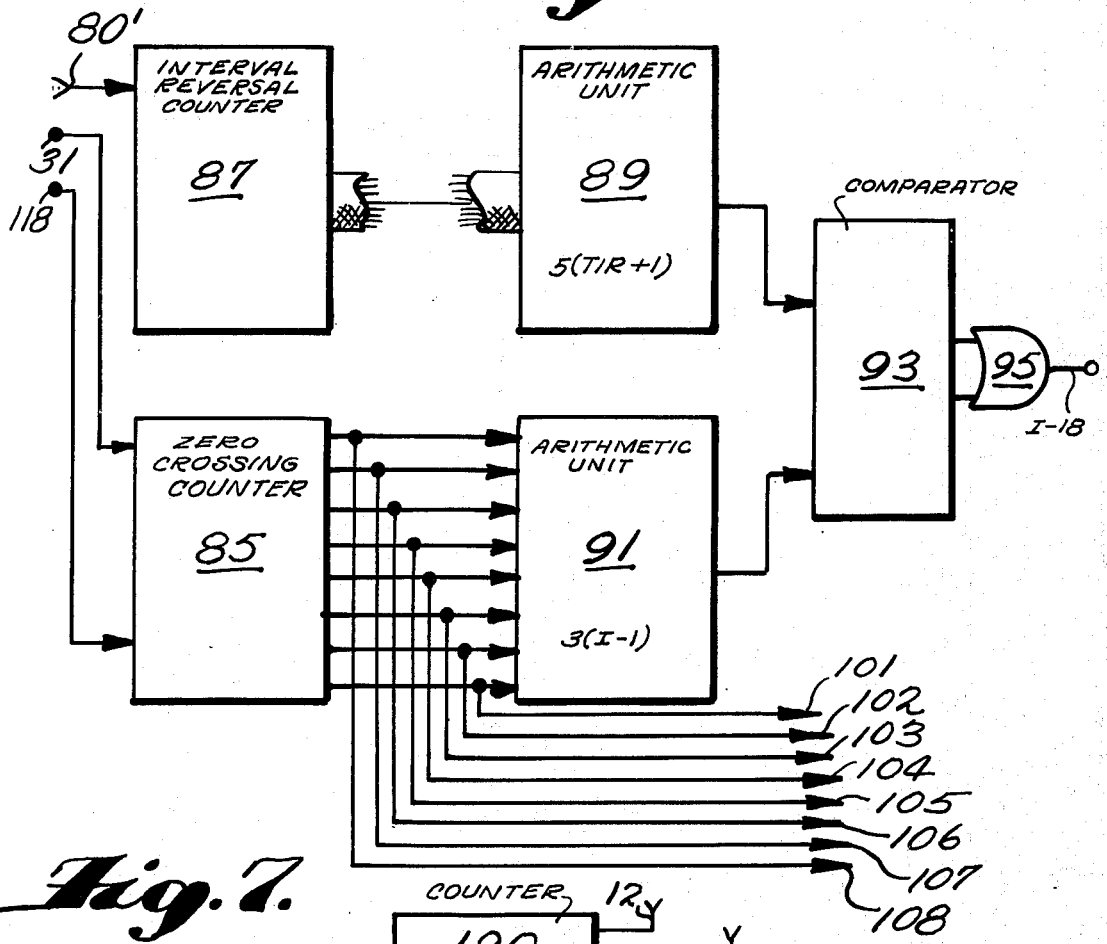
FIG. 2 is a circuit for determining the number of intervals in the zero crossing pattern.

Refer now to FIG. 2, which is a circuit for determinign whether the jaggedness measure, ΔS is greater than or equal to 0.6. As aforementioned, the following formula is utilized to determine the magnitude of the jaggedness of the speech crossover pattern which is determined in terms of time interval duration reversals:

$$\Delta S = \text{no. of time interval reversals} + 1/\text{number of intervals} - 1$$

When applied against the critical jaggedness value of 0.6, this formula can be recast in terms of the following inequality:

$$5\ (\mathrm{TIR} + 1) \quad 3\ (\mathrm{I} - 1)$$

wherein TIR is the number of time interval reversals and I is the number of intervals per pitch pulse period.

With respect to FIG. 2, eight bit binary counter 85 receives the output of flip flop 29 which appears on line 31. Accordingly, this counter determines the number of zero crossings of the infinitely clipped speech pattern. Eight bit binary counter 87 counts the number of interval reversals which are represented by the pulses at the output of OR gate 83. The count of the zero crossover counter 85 is preset to a count of minus 1 and the time interval reversal counter 87 is preset to a count of positive 1. Each of these counters is of conventional design and can be easily obtained commercially. The output of zero crossover counter 85 is coupled to an eight bit arithmetic unit 91 which computes the following quantity:

$$3\ (\mathrm{I} - 1)$$

Arithmetic unit 89 receives the output of the time interval reversal counter 87 and calculates the following quantity:

$$5\ (\mathrm{TIR} + 1)$$

The output of the arithmetic units 89 and 91 are coupled to a digital comparator 93 which determines whether the quantity 5 (TIR +1) is greater than or equal to 3 (I −1). This output is coupled to OR gate 95 and will be utilized, as will be seen hereinbelow, to classify the phonemes /a/ and /ə/. This if the quantity 5 (TIR +1) is less than 3 (I −1), the speech recognition system of this invention will indicate the occurrence of an /ə/, provided of course, that the other aforementioned criteria for detecting /ə/ are satisfied.

The arithmetic comparator units are not disclosed herein in detail since such circuits are well known to those skilled in electronic circuitry.

Refer now to FIG. 3, which is a logic diagram for determining whether the number of zero crossings of the infinitely clipped input voice signal is equal to 4, 6, 8 or 10. The binary coded outputs from the eight bit counter 85 designated by the numerals 101-108 are connected to the associated inputs 101'-108' of the logic circuitry illustrated in FIG. 3. Since the eight bit counter 85 is preset to the count of minus 1, the logic circuitry of FIG. 3 is arranaged so that when a binary coded 3 appears at the input thereof, AND gate 109 will provide an output of logical one. Thus in the case where 4 intervals have been counted by eight bit counter 85, the output thereof will be a logical one at inputs 101' and 102' and zeroes at each of the remaining intputs. The input signals at terminals 101' and 102' are coupled directly to AND gate 109 while the inputs at the terminals 103' and 104' are coupled to NOR gate 110 which provides a logical one output when both inputs thereto are logical zeroes. In addition, since each of the inputs at terminals 105'-108' are logical zeroes, NOR gates 111 and 112 each provide a logical one at their respective outputs. Accordingly, AND gate 113 provides a logical one to the fourth input terminal of AND gate 109. Thus the output of the AND gate 109 is a logical one while the remaining AND gates provide a logical zero output.

As a second illustrative example of the operation of the logic circuit of FIG. 3, assume that the counter 85 counts 6 crossover intervals. The output of counter 85 will be 5 in binary format. Accordingly, the inputs on lines 101′ and 103′ will be a logical one and on the remaining input lines will be logical zeroes. AND gate 114 will therefore be enabled to provide a logical one output to indicate that 6 binary intervals have been counted. It can be seen from the logical diagram that whenever a binary coded digit representing a 3, 5, 7 or 9 is provided at the output of counter 85, AND gates 109, 114, 115 and 116, respectively, will provide a logical one at the output thereof. If any other binary coded output values apppear on lines 101′-108′, the AND gates 109, 114, 115 and 117 will provide logical zeroes at the output thereof.

Figure 4:
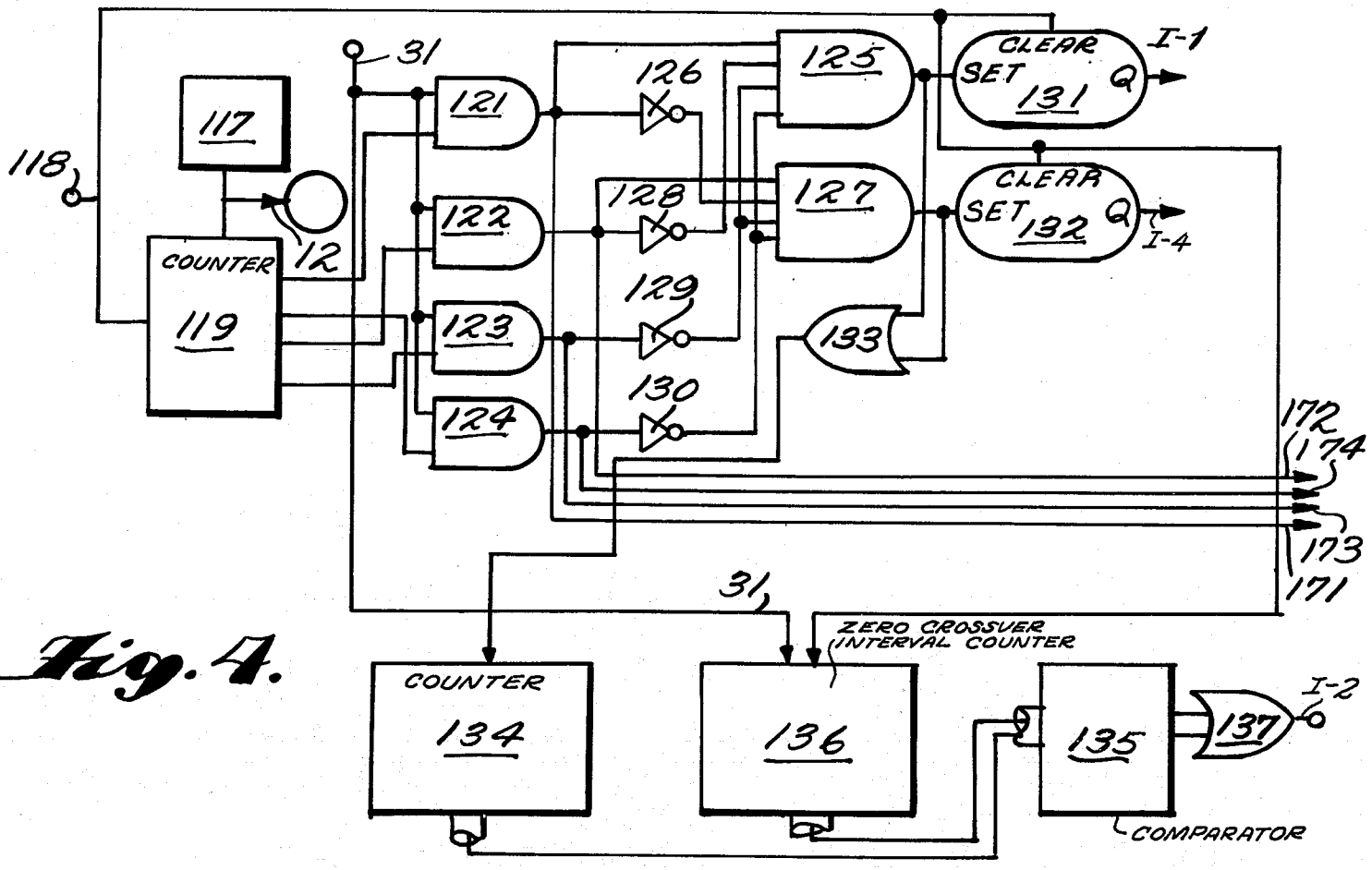
FIG. 4 is a logic circuit for determining if the individual intervals in the zero crossover pattern include intervals having lengths 1 or 2 and for determining the number of intervals of length 1 or 2 in a pitch pulse interval.

Refer now to FIG. 4, which is a circuit for timing the duration of the individual zero cross-over intervals. A 10 KHz clock 117 which may be of any suitable type provides a train of clock pulses to a four bit counter 119. The outputs of the four bit counter 119 are coupled to an associated series of AND gates 121-124. The other input to these AND gates is connected to the output of one — shot 29, which output is a pulse train representing the time position and number of zero crossings of the infinitely clipped input speech signal. Thus when a pulse at the output of oneshot 29 appears at one input of AND gate 121 and the first counter output is in a logical one state representing a time interval of 0.1 milliseconds, AND gate 121 is enabled to thereby provide a logical one output, this output is coupled directly to AND gate 125 and via invertor 126 to a second AND gate 127. Each of the remaining AND gates 122-124 have outputs in the logical zero state. These outputs are inverted by inverters 128-130 and coupled to AND gate 125. Because each of the inputs at AND gate 125 is in a logical one state, flip flop 131 is set. At the same time AND gate 127 is inhibited because of the logical zero input thereto from AND gate 121. Accordingly, flip flop 132 remains in the reset state. With flip flop 131 set, the Q output thereof is a logical one which indicates that a time interval of duration 1, i.e., 0.1 milliseconds, is present in the infinitely clipped zero crossover pattern.

It can be seen by inspection of the circuit that when there simultaneously occurs an input on line 31 from one shot 29 and a logical one output at the second terminal of counter 119, flip flop 132 is set to indicate that an interval of length 2, i.e., 0.2 milliseconds, is present in the zero crossover pattern.

Since information relating to the occurrence of intervals having a length of 3 to 8 in the zero crossover pattern is not important for detecting sounds, the circuitry is so designed that when a logical one appears at either the third or fourth terminals of the four bit counter 119 simultaneously with an input on line 31, neither flip flop 125 nor 127 will be enabled since the output of AND gates 123 and 124 is inverted by invertors 129 and 130, respectively. Thus at least one input to AND gates 125 and 127 will be zero thereby inhibiting the gates. After a predetermined period of time, the flip flops 131 and 132 along with counter 119 are reset by a reset pulse received at terminal 118, which pulse is in time concidence with the end of a pitch pulse interval. The derivation of the pulse will be explained hereinbelow.

Whenever a logical one appears at the output of AND gates of 125 or 127, this output is coupled via OR gate 133 to an eight bit binary counter 134. Thus counter 134 counts the number of intervals of length 1 and 2 in the zero crossover pattern. The output of eight bit counter 134 is coupled to one input of comparator 135. The other input to comparator 135 is derived from a zero crossover interval counter 136 which counts the number of pulses generated by one shot circuit 29. Accordingly, the output of counter 136 is equal to the number of intervals in the zero crossover pattern. The function of comparator 135 is to determine whether the sum of the number of intervals of length 1 and 2 is greater than or equal to one-half the intervals counted by counter 136. If such is the case a logical one appears at the output of OR gate 137. It will be recalled that when the sum of the total number of intervals of length 1 or 2 in a pitch pulse period is greater than half the total number of intervals, the occurrence of the sound /i/ is confirmed.

Comparator 135 includes a pair of binary intergrated counter circuits so wired that a logical one pulse is generated when the input from the counter 134 is either greater than or equal to one-half the input from interval counter 136. Such circuits are well known in the art and accordingly are not illustrated herein in detail. After the maximum duration of the sampling interval has expired, a reset pulse resets the counters 134 and 136.

Figure 5:
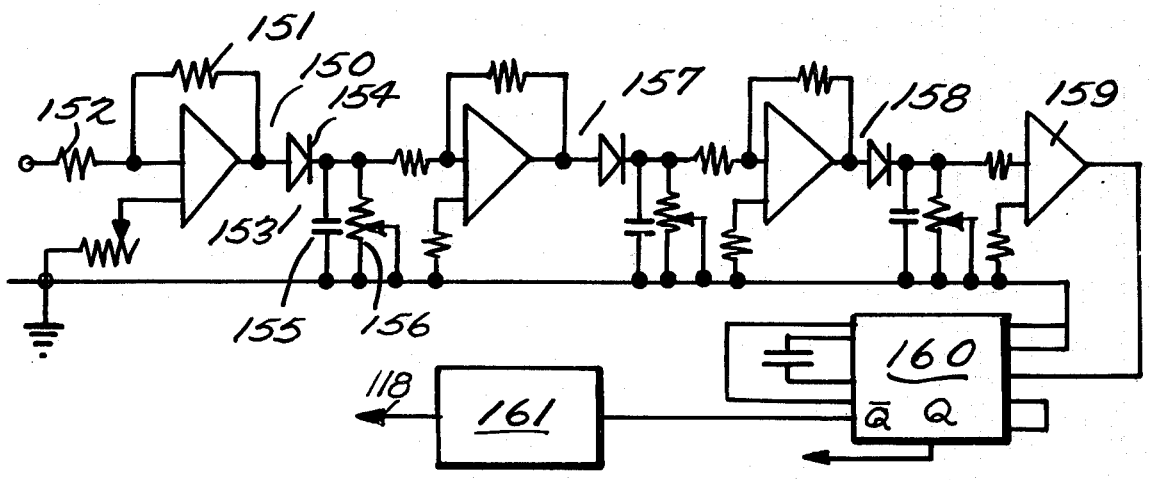
FIG. 5 is the pitch pulse detector of the present invention.

Refer now to FIG. 5 which discloses a pitch pulse detector circuit. It will be recalled that the input speech signal is sampled in synchronism with the glottal puffs or pitch pulses. The pitch pulses are the highest similar and repetitive peaks occurring in the speech signal. Since the magnitude and frequency of the repetitive peaks are both variable, a simple frequency filtering scheme is not sufficient for reliable detection thereof. Accordingly, a system such as disclosed in FIG. 5 is provided which includes three peak detectors in cascade which successively enhance the largest signal peaks while suppressing smaller ones. The input signal is coupled to a first amplifier stage 150 which has a gain determined by the values of the feedback resistor 151 and the input resistor 152. The output of amplifier 150 is coupled to an RC integrator circuit 153 via a rectifying diode 154. The diode 154 is connected so as to allow only the position peaks of the signals to reach the RC integrator. Capacitor 155 of the integrator charges quickly through diode 154 and the low output impedance of the amplifier 150.

When the amplifier output voltage drops below the voltage stored in capacitor 155, the diode 154 stops conducting and the capacitor begins to discharge slowly through the large variable resistor 156. Thus only those signal peaks which bring diode 154 into conduction are transmitted to the next stage. Each of the succeeding amplifier stages 157 and 158 are identical peak detectors which enhance the largest signal peaks at the output of amplifier 150 and which suppress smaller peak signals. Accordingly, only relatively high signal peaks are isolated and detected by the detectors 150, 157 and 158 so that only the glottal pitch pulses are isolated from the input signal.

The output of the last stage 158 of the pitch pulse detector is coupled to an amplifier 159 which amplifies the detected glottal pitch pulses. The output of amplifier 159 drives a bistable circuit 160 which acts as a pulse shaping circuit and which provides output pulses which are uniform in magnitude and duration and which are in synchronism with the input pitch pulses. The complementary output of bistable circuit 160 is coupled to a one-shot circuit 161, the output of which is utilzed to reset the counter circuit 85 shown in FIG. 2, the counters 134 and 136 shown in FIG. 4 and the flip-flops 131 and 132 illustrated in FIG. 4. The Q output of bistable circuit 160 is utilized to trigger a readout device. Counter 119 of FIG. 4 is reset by the output of oneshot 37 of FIG. 1.

Figure 6:
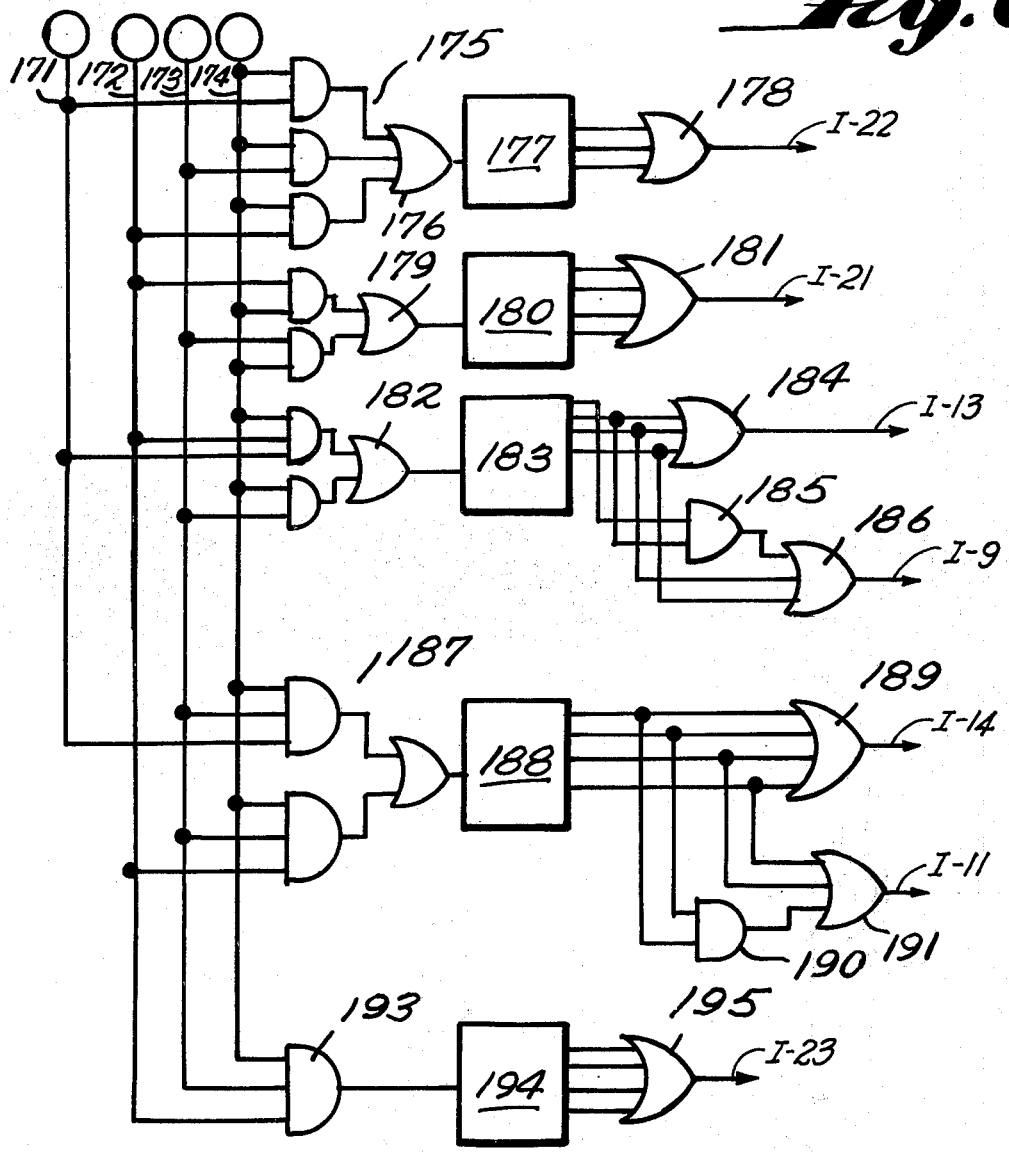
FIG. 6 is a logic circuit for deriving the interval lengths and frequency of occurrence of intervals of predetermined length in the input speech zero crossover pattern.

Refer now to FIG. 6 which discloses logic circuitry for computing the number of the intervals in the input infinitely clipped, zero crossover pattern and for determining the frequency of occurrence of various interval lengths. It will be remembered that the number of intervals and the frequency of occurrence of specific intervals is important to determine which phonemes are in the input speech signal. At the inputs to the logic circuit on lines 171-174 are binary coded signals derived from the output of AND gates 121-124, respectively, of FIG. 4. These inputs which are in binary form indicate the time duration of respective crossover intervals having a time duration of up to 1.6 milliseconds. Logic circuit 175 determines when there is an occurrence of the interval of length greater than 8, i.e., 0.8 milliseconds duration. When such an interval occurs a logical one signal is coupled via OR gate 176 to a 4 bit counter 177. Four bit counter 177 counts the number of occurrences of intervals having a length greater than 8 during a pitch pulse period with the output thereof being coupled to an OR gate 178. The counter 177 is preset to provide a high or logical one output when two or more input pulses are derived from OR gate 176. Thus the output of OR gate 178 is a logical one signal when two or more intervals of length greater than 8 are present in the input zero crossover pattern.

Logic circuit 179 determines when an interval having a length greater than 9 is present in the input zero crossover pattern. The output of circuit 179 is coupled to a 4 bit counter 180 which counts the number of occurrences of intervals greater than 9 during a given pitch pulse period. The output of counter 180 is coupled to an OR gate 181 which provides a logical one output when one or more intervals of length greater than 9 are present in the input zero crossover pattern. Circuit 182 determines when an interval of length greater than 10, that is, 1 millisecond, is present in the input zero crossover pattern. The output of this circuit is coupled to a 4 bit counter 183 which provides an output to OR gate 184, AND gate 185 and OR gate 186. OR gate 184 provides a logical one output when two or more intervals of length greater than 10 are present in the input zero crossover pattern. This can be accomplished by presetting counter 183 to a count of minus one or by coupling only the binary $2^1$, $2^2$ and $2^3$ output terminals to OR gate 184. AND gate 185 is enabled when there are three intervals of length greater than 10 present in the input zero crossover pattern. The output of AND gate 185 plus the remaining outputs of the 4 bit counter 184 are coupled to OR gate 186 which provides a pulse output when three or more intervals greater than 10 are present in the input signal.

Logic circuit 187 determines when an input zero crossover interval of length greater than 12 occurs. The output of circuit 187 is coupled to a 4 bit counter 188 which counts the number of occurrences of intervals of length greater than 12. The output of counter 188 is coupled to a first OR gate 189 and to an AND gate 190 and a second OR gate 191. OR gate 189 provides a pulse output when one or more intervals of length greater than 12 is present. The combination of AND gate 190 and OR gate 191 provides an output pulse when three or more intervals having a length greater than 12 are present in the input zero crossover pattern.

Finally, AND gate 193 is enabled when an interval greater than 13 is present in the input infinitely clipped, zero crossover speech pattern. The output of AND gate 193 is coupled to four bit counter 194 and the output of counter 194 is coupled to an OR gate 195 which provides a logical one output when 1 or more intervals have been counted which have an interval of length 13 or greater. Each of the logic elements including the AND and OR gates and the 4 bit counters are covnentional circuit components which are readily available commercially. Accordingly, the manner in which these circuits are wired to provide the logical signals aforementioned are not described in detail herein. Each of the counter circuits are reset at the end of a pitch pulse interval by means of pulses derived at the output of one shot circuit 161 illustrates in FIG. 5. The signals derived at the output of the various OR gates will be utilized in a manner disclosed more fully in connection with the discussion of FIGS. 8*a* and 8*b*.

Refer now to FIG. 7 which is a circuit for determining the five time duration ranges into which the pitch pulse period falls. At eight bit counter 190 is driven by the output clock pulses from clock, pulse generator 118 illustrated in the circuit of FIG. 4. The output of counter 190 is in binary form and is utilized to drive comparators 191,192, 193 and 194. Counter 190 counts the number of clock pulses occurring between the start and termination of a pitch pulse period, which period is determined by the occurrence of a reset pulse on line 118 and derived from one-shot circuit 161 illustrated in FIG. 5. Comparators 191-194 are each comprised of a pair of conventional digital integrated comparator circuits which may be readily obtained commercially. As an illustrative example, Signetics IC circuit 7485 may be utilized. Each of these comparators is hard wired in a known manner to provide the appropriate comparison levels referred to hereinbelow. Thus, for example, comparator 191 provides a pulse signal at terminal 194 when the input count from counter 190 is less than 4 milliseconds. Terminals 195 and 196 provide pulse outputs when the time period as counted by counter 190 is equal to or greater than 4 milliseconds, respectively. These outputs are coupled to an OR gate 197 with the output of OR gate 197 coupled to AND gate 198. When the time interval as counted by counter 190 is less than 5.7 milliseconds, a pulse is provided at output terminal 194 of comparator 192. When the time interval is equal to 5.7 milliseconds, a pulse is provided at output terminal 195 and a pulse is provided at output terminal 196 which is connected to AND gate 200 when the time interval of the pitch pulse period is greater than 5.7 milliseconds. Accordingly, it can be seen that AND gate 198 will be enabled when the input pitch pulse period is equal to or greater than 4.0 milliseconds, but less than or equal to 5.7 milliseconds.

Refer now to comparator 193 which provides pulse outputs on line 194 and 195 when the pitch pulse interval is determined by counter 190 is less than or equal to 7.5 milliseconds. These outputs are coupled via OR gate 201 to AND gate 200. The other input to AND gate 200 is derived from terminal 196 of comparator 192 which provides a pulse output when the duration of the pitch pulse interval is greater than 5.7 milliseconds. Thus AND gate 200 is enabled when the duration of the pitch pulse period is greater than 5.7 milliseconds, but less than or equal to 7.5 milliseconds.

Comparator 194 provides a pulse at output terminals 194 and 195 when the time duration of the pitch pulse period is less than or equal to 9 milliseconds, respectively. These outputs are coupled to AND gate 202. The other input to AND gate 202 is derived from output terminal 196 of comparator 193 which provides a pulse when the duration of the pitch pulse interval is greater than 7.5 milliseconds. Accordingly, gate 202 is enabled when the pitch pulse period is greater than 7.5 milliseconds, but less than or equal to 9.0 milliseconds. The output 196 of comparator 194 provides a pulse when the pitch pulse period is greater than 9 milliseconds. The output signals from the comparators illustrated in FIG. 7 are utilized to classify the speech signals into one of the classifications of aforementioned phonemes in a manner to be discussed more fully in connection with the description of the circuit of FIGS. 8*a* and 8*b*.

Figure 8A:
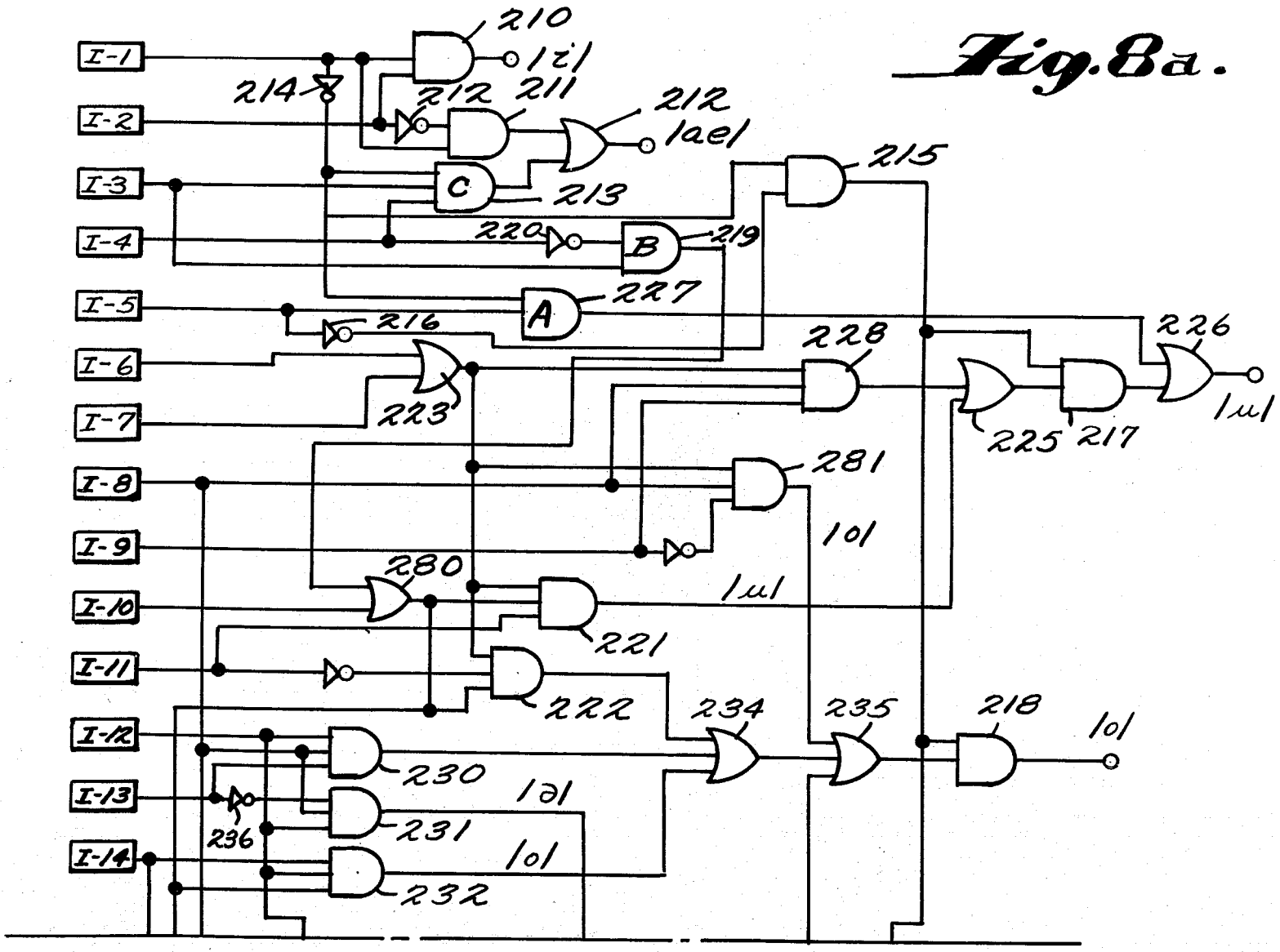
FIGS. 8*a* and 8*b* illustrate the logic circuits for classifying the parameters derived from the zero crossover pattern into six different sound categories.
Figure 8B:
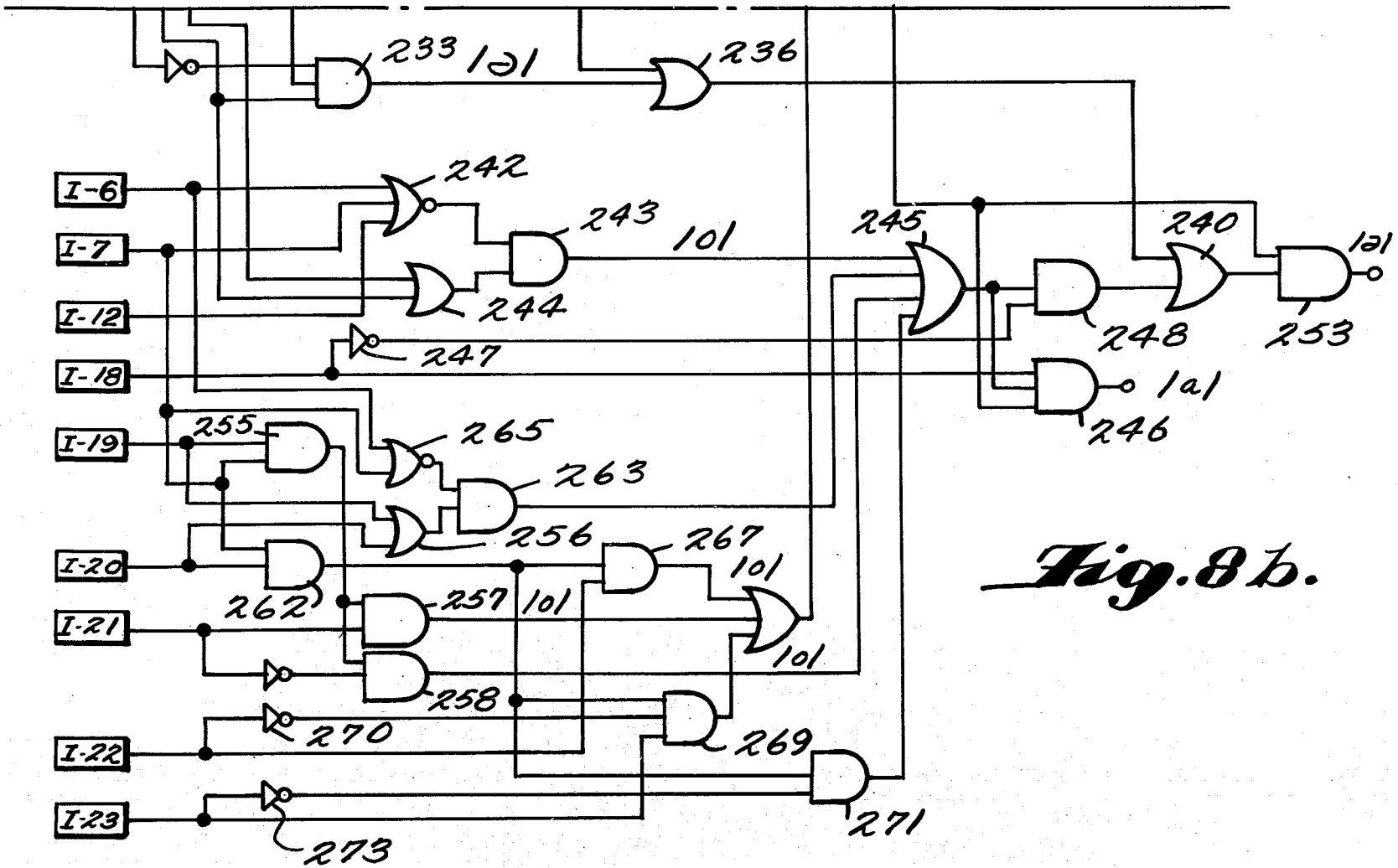

Refer now to FIGS. 8*a* and 8*b* which are schematic logic diagrams of the output circuit for classifying the various phonemes which constitute the speech elements to be decoded. The output of flip-flop 131 in FIG. 4 which indicates when a zero crossover interval of length 1 is present in the input zero crossover pattern, is coupled to AND gate 210 via input terminal I-1. The other input to AND gate 210 is derived from the output of OR gate 137 in FIG. 4 which output is an indication of whether the number of intervals of length 1 and 2 is greater than or equal to one-half the total number of intervals in the pitch pulse period. This inequality may be set forth as follows:

$$I/2 \quad (\text{No. of } 1\text{'s} + \text{no. of } 2\text{'s})$$

Thus when at least one interval of length 1 exists in the zero crossover pattern and the number of intervals of length 1 and 2 is greater than or equal to one-half the total intervals in the pitch pulse period, AND gate 210 is enabled to provide a logic one output whicn indicates that the sound being detected is the phoneme /i/.

The inputs to AND gate 211 is derived directly from terminal I-1 and from I-2 via an invertor 212. Hence AND gate 211 is enabled when there exists at least 1 interval of length 1 and the total number of intervals of length 1 and 2 is less than one-half the total number of intervals in the pitch pulse period. The appearance of a logic one at the output of AND gate 211 indicates that the sound /ae/ is present in the input speech signal. This logic signal is coupled through OR gate 212 to an appropriate output terminal. One input to AND gate 213 is derived directly from input terminal I-3 which is connected to the output of comparator 194 in FIG. 7, which output indicates that the pitch pulse period is greater than 9.0 milliseconds. A second input to AND gate 213 is derived from input terminal I-1 via inverter 214. The third input to AND gate 213 is derived from input terminal I-4 which is connected to flip-flop 132 in FIG. 4. A pulse at terminal I-4 indicates that an interval of length 2 appears in the crossover pattern of the input speech signal. The AND gate 213 is enabled when at least one interval of length 2 appears in the pattern, no intervals of length 1 occur, and the pitch pulse period is at least 9 milliseconds in length. The output of AND gate 213 is coupled to an appropriate output terminal via OR gate 212.

The inputs to AND gate 215 are derived from input terminal I-1 via invertor 214 and from input terminal I-5 via invertor 216. Input terminal I-5 is derived from the outut of AND gate 109 in FIG. 3 which provides a pulse when the number of zero cross-over intervals in the pitch period is equal to 4. Accordingly, AND gate 215 is enabled when the number of crossover intervals in a pitch pulse period is not equal to 4 and when no intervals of length 1 appear in the input signal. The output of AND gate 215 is coupled to AND gates 217 and 218.

The inputs to AND gate 219 are derived from input terminal I-4 via logical invertor 220 and directly from input terminal I-3. Accordingly, AND gate 219 is enabled when an interval of length 2 does not appear in the input crossover pattern and the pulse pitch period is greater than 9 milliseconds. The output of AND gate 219 is coupled to one input of OR gate 280. The other input to OR gate 280 is derived from input terminal I-10 which is connected to the output of comparator 194 shown in FIG. 7. The signal on input line I-10 is a logical one when the pulse pitch period is greater than 7.5 milliseconds and less than or equal to 9 milliseconds. The output of OR gate 280 is coupled to one input of AND gate 221 and to one input of AND gate 222. A second input to AND gate 221 is derived from an input terminal I-11 which is coupled to the output of OR gate 191 shown in FIG. 6, which gate provides a logical one signal when three or more intervals of length greater than 12 are present on the input crossover pattern. The other input to AND gate 221 is derived from the output of OR gate 223 which has its input terminals coupled to I-6 and I-7. Terminals I-6 and I-7 are coupled to the outputs of AND gates 114 and 115, respectively, shown in FIG. 3. AND gate 114 generates an output pulse when the number of intervals in the input crossover pattern is equal to 6, and AND gate 115 generates an output pulse when the number of input crossover intervals is equal to 8.

Accordingly, AND gate 221 is enabled when the number of zero crossover intervals in the input signal is equal to 6 or 8, the pitch pulse period is greater than 7.5 milliseconds but less than or equal to 9 milliseconds and there are three or more intervals of length greater than 12. When the aforementioned conditions occur, AND gate 221 provides an output which indicates that the sound /u/ exists in the input speech signal. The output of AND gate 221 is coupled to OR gate 225, the output of which is coupled to AND gate 217. The other input to AND gate 217 is derived from AND gate 215. The output of AND gate 217 is coupled to an output terminal via OR gate 226. When a pulse appears at the output of OR gate 226, the sound /u/ has been detected. The logic circuitry of FIG. 8*a* provides a second test to determine whether the sound /u/ appears in the input signal. Thus, AND gate 227 is provided having one input coupled directly thereto from input terminal I-5 which terminal is connected to the output of AND gate 109 in FIG. 3. An input pulse at terminal I-5 indicates that there are four zero crossover intervals in the pitch period being examined. The outer input to AND gate 227 is derived from input terminal I-1 via invertor 214. Accordingly, an input pulse at this terminal of AND gate 227 exists when no zero crossover intervals of length 1 exist in the input signal. The output of AND gate 227 is coupled directly to OR gate 226. When AND gate 227 is enabled, an output pulse is generated at the output of OR gate 226 to indicate that the sound /u/ has been detected. A third test for the occurrence of the sound /u/ is provided. Thus AND gate 228 has three inputs which are connected to the output of OR gate 223, the input terminal I-8 and the input terminal I-9. Input terminal I-9 is connected to the output of OR gate 186 illustrated in FIG. 6. Accordingly, when a signal pulse appears at terminal I-9, three or more intervals of length greater than 10 appear in the input speech signal. Input terminal I-8 is connected to the output of AND gate 200 shown in FIG. 7. Accordingly, an input signal at terminal I-8 is an indication that the pitch pulse period is greater than 5.7 milliseconds, but less than or equal to 7.8 milliseconds. It therefore can be seen that if three or more intervals of length greater than 10 appear in a pitch pulse period, wherein the total number of intervals in the pitch period is either 6 or 8 with the pitch period having a duration between 5.7 milliseconds and 7.5 milliseconds, AND gate 228 will provide an output which is coupled to the input of OR gate 225. The output of OR gate 225 is coupled to AND gate 217 with an output therefrom indicating that the sound /u/ exists in the input speech signal.

Input terminal I-12 which is connected to the output of AND gate 116 shown in FIG. 3 at one end is connected at the other end to one input terminal of AND gates 230, 231, 232, and 233. An input signal at this terminal indicates that there are 10 zero crossover intervals in a pitch pulse interval of the input speech signal. Input terminal I-13 is connected to a second input of AND gate 230 on one side thereof and to the output of OR gate 184 shown in FIG. 6. A pulse appearing at the input terminal I-13 indicates that two or more intervals having a length greater than 10 are present in the input zero crossover pattern. The final input to AND gate 230 is derived from terminal I-8 which indicates by the presence of a pulse that the pitch pulse period is greater than 5.7 milliseconds but less than 7.5 milliseconds. The output of AND gate 230 is coupled directly to OR gate 234 with the output of OR gate 234 connected to one input of OR gate 235. The output of OR gate 235 is connected to one input of AND gate 218. Accordingly, with AND gate 218 enabled, an output pulse will occur at the output thereof to indicate that the sound /o/ has been detected.

AND gate 231 has one input connected directly to input terminal I-8, a second input connected to input terminal I-13 via invertor 236 and the third input connected to terminal I-12. When AND gate 231 is enabled an output pulse is provided which indicates that the sound /ə/ has been detected in the input signal. The output of AND gate 231 is coupled to OR gate 236 illustrated in FIG. **8*b*. AND gate 232 is enabled when the inputs thereto indicate the occurrence of a zero crossover pattern having one or more intervals of length greater than 12, at least one interval of length 10 and the occurrence of an output from OR gate 200. It will be recalled that OR gate 200 provides an output when the pitch pulse interval is greater than 7.5 milliseconds. When AND gate 232 is enabled, the sound /O/ has been detected in the input signal. The output of the AND gate 232 is coupled to the input of OR gate 234**, as illustrated in the drawings.

AND gate 233 is enabled when input thereto indicates that there are no intervals of length 12 or greater in a pitch period interval, the number of crossover intervals is equal to 10 and the pitch pulse interval is greater than 7.5 milliseconds. Thus, when AND gate 233 is enabled, the sound /ə/ has been detected at the input. The output of AND gate 233 is coupled to OR gate 236 with the output of OR gate 236 being coupled to OR gate 240.

AND gate 281 is enabled when the pitch pulse period is greater than 5.7 milliseconds and there are either 6 or 8 zero crossover intervals in the pitch pulse period. When AND gate 281 is enabled, the sound /O/ appears in the input speech signal. The output of AND gate 281 is coupled to AND gate 218 via OR gate 235.

Input terminals I-6, I-7 and I-12 are each coupled to the input of NOR gate 242. Accordingly, NOR gate 242 provides a pulse output when the number of zero crossover intervals in a pitch pulse period is not equal to 6, 8 or 10. The output of NOR gate 242 is coupled to one input of AND gate 243. The other input to AND gate 243 is connected to the output of OR gate 244. It can be seen that OR gate 244 has a pulse output when the pitch pulse interval is greater than 5.7 milliseconds. Accordingly, ANd gate 243 is enabled when the pitch pulse interval is greater than 5.7 milliseconds and there are more than ten intervals in the pitch pulse period. Thus when AND gate 243 is enabled, the sound /o/ is detected in the input speech signal. The output of AND gate 243 is coupled to OR gate 245.

Input terminal I-18 is connected to the output of OR gate 95 in FIG. 2. A pulse appears at this terminal when the number of time interval reversals as given by the following formula is greater than 0.6:

$$\Delta S = (TIR + 1)/(I - 1)$$

Terminal I-18 is coupled to AND gate 246 and is logically inverted by inverter 247 and coupled AND gate 248. Thus, AND gate 246 is enabled when there is a simultaneous occurrence of a pulse at the output of AND gate 215, NOR gate 245 and a pulse at terminal I-18. When AND gate 246 is enabled, the sound /a/ has been detected at the input. It can also be seen that when the value for $\Delta S$ is less than 0.6 and AND gate 243 has been enabled, ANd gate 248 is enabled to thereby provide a pulse to the input of AND gate 253 thereby indicating that the sound /ə/ has been detected in the input speech signal. Input terminal I-19 is connected to the output of comparator 191 of FIG. 7 and conveys a pulse to AND gate 255 and OR gate 256 when the pitch pulse interval is less than 4 milliseconds. The output of AND gate 255 is coupled to AND gates 257 and 258. The other input to AND gate 257 is derived from terminal I-21 which is connected to the output of OR gate 181 shown in FIG. 6. A pulse at the terminal I-21 indicates that one or more intervals greater than 9 appear in the input zero crossover pattern. Accordingly, when AND gate 257 is enabled, the sound /o/ has been detected. The logical inverse of the signal at I-21 is coupled to AND gate 258, the output of which is coupled directly to OR gate 245.

Input terminal I-20 is connected to one end to the output of AND gate 198 shown in FIG. 7, and at the other end, to one input of OR gate 256 and one input of AND gate 262. When a pulse appears at terminal I-20, the pitch pulse period is greater than or equal to 4 milliseconds, but less than or equal to 5.7 milliseconds. The output of OR gate 156 is coupled to one input of AND gate 263 with the other input of AND gate being connected to input terminals I-15 and I-16 via NOR gate 265. The output of AND gate 263 is connected to one input of OR gate 245. When AND gate 263 is enabled, either an /a/ or an /ə/ is detected in the input signal depending on whether the value of $\Delta S$ at terminal I-18 is greater than or less than 0.6, respectively.

The output of AND gate 262 is connected to one input of AND gate 267 and to one input of AND gate 269. Input terminal I-22 is connected at one end to the output of OR gate 178 shown in FIG. 6 and at the other end to AND gate 267 and via an inverter 270 to AND gate 269. Accordingly, when AND gate 267 is enabled, the sound /o/ appears in the input speech signal. Finally, input terminal I-23 is connected at one end to the output of OR gate 195 shown in FIG. 6, and at the other end, to one input terminal of AND gate 269 and via a logical invertor 273 to one input terminal of AND gate 271. Thus it can be seen that AND gate 269 is enabled when the pitch pulse period is between 4 and 5.7 milliseconds has exactly eight intervals and contains at least one interval of length greater than 13. When this criteria is satisfied, the sound /o/ has been detected in the input speech signal.

Finally, AND gate 271 is enabled when the pitch pulse period is between 4 and 5.7 milliseconds long and has exactly eight zero crossover intervals therein. This condition can be satisfied by either the /a/ or /ə/ sounds. However, the output of AND gate 271 is coupled to AND gates 246 and 248. It will be recalled that AND gate 246 is enabled when the value ΔS at input terminal I-18 is greater than 0.6, thereby indicating that the sound /a/ has been detected. When the value of S is less than 0.6, AND gate 248 is enabled thereby indicating that the sound /ə/ has been detected. It can be seen from examining FIGS. 8A and 8B that by operating on the signals derived in the circuits disclosed in FIGS. 1-7 by an appropriate logic circuitry, the phonemes /ae/, /a/, /ə/, /i/, /u/, and /o/ can be derived from an infinitely clipped input speech signal.

It should be understood that other circuits could be utilized to practice applicants' invention as defined by the appended claims.

What is claimed is:

1. A speech recognition system comprising means for detecting the pitch pulse period of an input speech signal, means for clipping said input speech signal to obtain the zero crossover pattern thereof, means responsive to said pitch pulse period detecting means for quantizing the zero crossover pattern of said clipped input speech signal, and means for classifying the quantized zero crossover pattern in accordance with the pattern of one of a plurality of phonemes.

2. The speech recognition system of claim 1 wherein said means for quantizing the zero crossover pattern of said clipped input speech signal comprises, means for determining the number of zero crossover intervals per pitch pulse interval, means for deriving the time duration of said zero crossover intervals, means for detecting when the time duration of successive zero crossover intervals changes from increasing to decreasing, and vice versa, and means responsive to said time duration interval change detecting means for computing the jaggedness, ΔS, of the zero crossover pattern, said jaggedness being proportional to the number of times the duration of said zero crossover intervals changes from successively increasing to successively decreasing.

3. The speech recognition system of claim 2 wherein said means for detecting the pitch pulse period of said input speech signal comprises peak detecting means for enhancing the glottal pulses generated by the voicing of said speech signal, and means for generating pitch period pulses in time synchronism with said enhanced glottal pulses.

4. The speech recognition system of claim 3 wherein said means for detecting said pitch pulse period further comprises clock means for generating a plurality of clock pulses, counter means for counting said clock pulses during the time period between successive pitch period pulses, and comparator means for determing the level of the count of said counting means, said comparator means indicating the time duration of the pitch pulse period relative to at least one predetermined time interval.

5. The speech recognition system of claim 4 wherein said means for detecting when the time duration of successive zero crossover intervals changes from increasing to decreasing, and vice versa, comprises means for generating a signal which is proportional to the time duration of said zero crossover intervals, first detector means for generating a pulse only when said signal increases in amplitude, second detector means for generating a pulse only when said signal decreases in amplitude, and bistable means having its inputs connected to said first and second detecting means, said bistable means changing its state only when said first and second detecting means successively generate pulses.

6. A time domain speech recognition system for detecting phonemes in a voiced speech signal comprising means for detecting the pitch pulse period of the glottal pulses generated by said voiced speech signal, means for generating a train of pulses in synchronism with the zero crossover pattern of said voiced speech signal, means responsive to said pitch pulse period detecting means for quantizing the zero crossover pattern of said speech signal, and means for classifying the quantized zero crossover pattern in accordance with the pattern of one of a plurality of phonemes.

7. The speech recognition system of claim 6 wherein said pulse train generating means generates said pulses in synchronism with said pitch pulse period.

* * * * *